US009160049B2

(12) United States Patent
Hills et al.

(10) Patent No.: US 9,160,049 B2
(45) Date of Patent: Oct. 13, 2015

(54) ANTENNA ADAPTER

(71) Applicant: Andrew LLC, Hickory, NC (US)

(72) Inventors: Christopher D Hills, Glenrothes (GB); Alexander Peter Thomson, Livingston (GB); Claudio Biancotto, Edinburgh (GB); Donald B Gardner, Livingston (GB)

(73) Assignee: CommScope Technologies LLC, Hickory, NC (US)

( * ) Notice: Subject to any disclaimer, the term of this patent is extended or adjusted under 35 U.S.C. 154(b) by 413 days.

(21) Appl. No.: 13/677,859

(22) Filed: Nov. 15, 2012

(65) Prior Publication Data

US 2013/0120089 A1 May 16, 2013

Related U.S. Application Data

(63) Continuation-in-part of application No. 13/297,304, filed on Nov. 16, 2011, now Pat. No. 8,558,746.

(51) Int. Cl.

| | |
|---|---|
| ***H01P 5/02*** | (2006.01) |
| ***H01Q 1/12*** | (2006.01) |
| ***H01P 5/12*** | (2006.01) |

(52) U.S. Cl.

CPC .. *H01P 5/02* (2013.01); *H01P 5/12* (2013.01); *H01Q 1/1207* (2013.01)

(58) Field of Classification Search

CPC ..... H01P 5/00; H01P 5/12; H01P 5/02; H01Q 5/30; H01Q 1/1207

USPC ..... 333/254; 343/857, 858, 870, 906

See application file for complete search history.

(56) References Cited

U.S. PATENT DOCUMENTS

| | | | |
|---|---|---|---|
| 2,573,746 | A | 11/1951 | Watson et al. |
| 2,862,728 | A | 12/1958 | Druschel et al. |
| 2,981,948 | A | 4/1961 | Kurtz |
| 3,157,847 | A | 11/1964 | Williams |
| 3,193,830 | A | 7/1965 | Provencher |
| 3,243,818 | A | 3/1966 | Holtzman |
| 3,281,851 | A | 10/1966 | Goebels, Jr. |
| 3,340,534 | A | 9/1967 | Fee |
| 3,570,007 | A | 3/1971 | Whitehead |
| 3,599,216 | A | 8/1971 | Paine et al. |
| 3,701,162 | A | 10/1972 | Seaton |

(Continued)

FOREIGN PATENT DOCUMENTS

| | | |
|---|---|---|
| WO | 9639730 | 12/1996 |

OTHER PUBLICATIONS

Sung Chul Kang, International Search Report of Counterpart International Application No. PCT/US12/65425, Mar. 29, 2013, Daejeon Metropolitan City, Korea.

*Primary Examiner* — Benny Lee
*Assistant Examiner* — Rakesh Patel
(74) *Attorney, Agent, or Firm* — Babcock IP, PLLC

(57) ABSTRACT

An antenna adapter, for an antenna with a recessed adapter seat with a feed bore is provided as a base with a feed aperture, the base dimensioned to seat within the adapter seat, the feed aperture aligned coaxial with the feed bore. The base may be provided with interlock cavities dimensioned to receive retaining elements of the adapter seat as the base is inserted into the adapter seat, retaining the base within the adapter seat. The base may include a coupler cavity, coupling the feed aperture to two or more output ports. The coupler cavity may have sidewall slots.

16 Claims, 11 Drawing Sheets

(56) References Cited

U.S. PATENT DOCUMENTS

| | | | |
|---|---|---|---|
| 4,121,220 | A | 10/1978 | Scillieri et al. |
| 4,429,313 | A | 1/1984 | Muhs, Jr. et al. |
| 4,527,165 | A | 7/1985 | de Ronde |
| 4,716,415 | A | 12/1987 | Kelly |
| 4,829,309 | A | 5/1989 | Tsukamoto et al. |
| 4,857,938 | A | 8/1989 | Tsukamoto et al. |
| 4,878,060 | A | 10/1989 | Barbier et al. |
| 4,916,458 | A | 4/1990 | Goto |
| 4,949,092 | A | 8/1990 | Crail et al. |
| 4,959,658 | A | 9/1990 | Collins |
| 4,985,708 | A | 1/1991 | Kelly |
| 5,010,351 | A | 4/1991 | Kelly |
| 5,019,831 | A | 5/1991 | Yee et al. |
| 5,086,304 | A | 2/1992 | Collins |
| 5,210,543 | A | 5/1993 | Kurtz |
| 5,243,354 | A | 9/1993 | Stern et al. |
| 5,270,721 | A | 12/1993 | Tsukamoto et al. |
| 5,321,411 | A | 6/1994 | Tsukamoto et al. |
| 5,327,150 | A | 7/1994 | Cherrette |
| 5,337,065 | A | 8/1994 | Bonnet et al. |
| 5,512,906 | A | 4/1996 | Speciale |
| 5,541,612 | A | 7/1996 | Josefsson |
| 5,579,019 | A | 11/1996 | Uematsu et al. |
| 5,589,843 | A | 12/1996 | Meredith et al. |
| 5,619,216 | A | 4/1997 | Park |
| 5,650,793 | A | 7/1997 | Park |
| 5,831,583 | A | 11/1998 | Lagerstedt et al. |
| 5,880,695 | A | 3/1999 | Brown et al. |
| 5,926,147 | A | 7/1999 | Sehm et al. |
| 6,101,705 | A | 8/2000 | Wolfson et al. |
| 6,127,985 | A | 10/2000 | Guler |
| 6,198,456 | B1 | 3/2001 | Le Halle et al. |
| 6,201,508 | B1 | 3/2001 | Metzen et al. |
| 6,225,960 | B1 | 5/2001 | Collins |
| 6,285,335 | B1 | 9/2001 | Snygg et al. |
| 6,304,228 | B1 | 10/2001 | Smith et al. |
| 6,476,772 | B1 | 11/2002 | Smith et al. |
| 6,535,173 | B2 | 3/2003 | Ou |
| 6,624,787 | B2 | 9/2003 | Puzella et al. |
| 6,657,599 | B2 | 12/2003 | Solbach |
| 6,720,931 | B1 | 4/2004 | Michisaka et al. |
| 6,731,241 | B2 | 5/2004 | Park et al. |
| 6,796,126 | B2 | 9/2004 | Hasegawa et al. |
| 6,861,996 | B2 | 3/2005 | Jeong |
| 6,950,066 | B2 | 9/2005 | Hendler et al. |
| 6,977,621 | B2 | 12/2005 | Kelly et al. |
| 6,985,057 | B2 | 1/2006 | Lesutis |
| 7,064,725 | B2 | 6/2006 | Shtrikman et al. |
| 7,079,087 | B2 | 7/2006 | Bateman et al. |
| 7,205,948 | B2 | 4/2007 | Krikorian et al. |
| 7,227,508 | B2 | 6/2007 | Wang et al. |
| 7,391,381 | B2 | 6/2008 | Wang et al. |
| D576,344 | S | 9/2008 | Conroy |
| 7,607,942 | B1 | 10/2009 | Van Swearingen |
| 7,663,566 | B2 | 2/2010 | Engel |
| 7,680,516 | B2 | 3/2010 | Lovberg et al. |
| 7,817,097 | B2 | 10/2010 | Margomenos |
| 7,948,443 | B2 | 5/2011 | Bullock et al. |
| 8,010,042 | B2 | 8/2011 | Judd et al. |
| 8,040,286 | B2 | 10/2011 | Matusuo et al. |
| 2004/0252073 | A1 | 12/2004 | Kukita et al. |
| 2005/0146479 | A1 | 7/2005 | Stenger et al. |
| 2007/0152906 | A1 | 7/2007 | Wong |
| 2008/0165078 | A1* | 7/2008 | Song ..... 343/906 |
| 2009/0302971 | A1 | 12/2009 | Rosenberg et al. |
| 2010/0066463 | A1 | 3/2010 | Rosenberg et al. |
| 2010/0085261 | A1 | 4/2010 | Baranski |
| 2011/0074652 | A1 | 3/2011 | Lewry et al. |
| 2012/0019424 | A1 | 1/2012 | Syed et al. |

* cited by examiner

ANTENNA ADAPTER

BACKGROUND

1. Field of the Invention

This invention relates to a microwave antenna. More particularly, the invention relates to an antenna adapter enabling simplified microwave antenna feed interface configuration and/or exchange.

2. Description of Related Art

A microwave antenna may be coupled to a wide range of signal generating and/or processing equipment, according to the end user's requirements, each with a different adapter and/or interface requirement.

A microwave antenna may be provided with an adapter assembly for coupling a transceiver or the like to the microwave antenna. The interconnection may be, for example, a direct interconnection or via a waveguide which then couples to the desired signal generating and/or processing equipment.

Microwave antennas may be provided with an interconnection with dual redundant transceivers, one of the transceivers provided as a hot standby to the other to improve the resulting RF system reliability. Alternatively, dual transceivers coupled to a single microwave antenna may be utilized simultaneously, each transceiver operating upon a signal with a different polarity, the signals separated and routed to each transceiver by an Orthomode Transducer (OMT).

Providing microwave antennas in multiple models, each configured for a specific interconnection type and/or provided with elaborate adapter assemblies, can be a significant manufacturing, supply chain, installation and/or ongoing maintenance burden.

Therefore it is an object of the invention to provide an antenna adapter that overcomes limitations in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

U.S. Utility patent application Ser. No. 13/297,304, titled "Flat Panel Array Antenna" filed Nov. 16, 2011 by Alexander P. Thomson, Claudio Biancotto and Christopher D. Hills, commonly now U.S. Pat. No. 8,558,746 issued Oct. 15, 2013, owned with the present application and hereby incorporated by reference in its entirety, discloses microwave antennas comprising a corporate waveguide network and cavity couplers provided in stacked layers, resulting in microwave antennas with significantly reduced dimensions compared to conventional reflector dish microwave antennas. Transceivers and the adapters utilized to mate such to these antennas may comprise a significant portion of the resulting assembly.

The inventors have recognized that prior adapters may be overly complex, overly large and/or require more installation steps than necessary.

Figure 1:
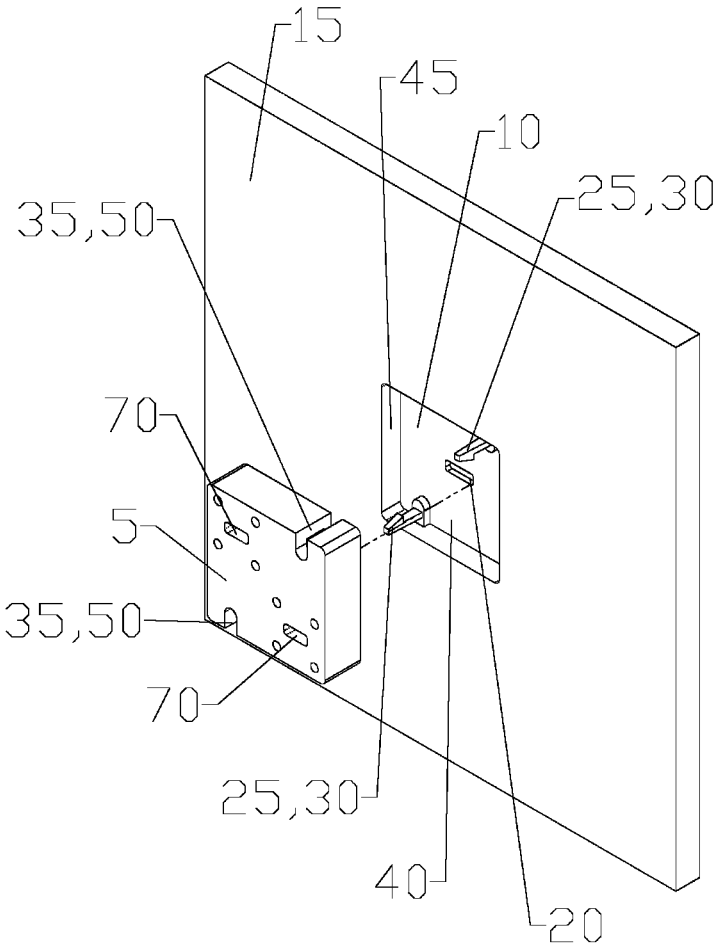
FIG. 1 is a schematic isometric view of an exemplary adapter aligned for insertion into the adapter seat of a flat panel antenna.
Figure 2:
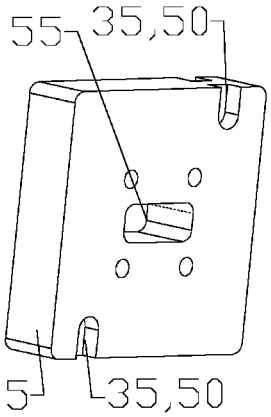
FIG. 2 is a schematic isometric front view of an adapter.
Figure 3:
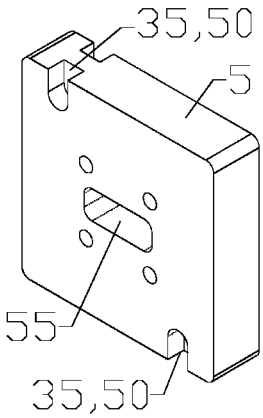
FIG. 3 is a schematic isometric back view of the adapter of FIG. 2.
Figure 4:
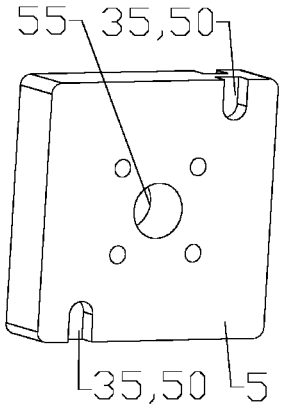
FIG. 4 is a schematic isometric front view of another adapter.
Figure 5:
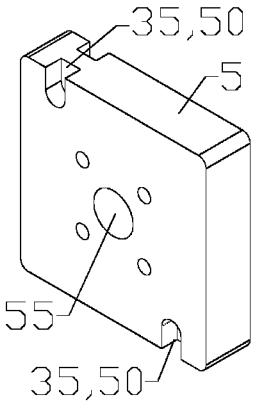
FIG. 5 is a schematic isometric back view of the adapter of FIG. 4.
Figure 6:
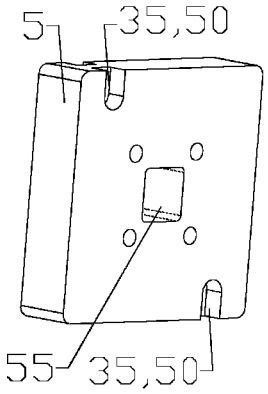
FIG. 6 is a schematic isometric front view of another adapter.
Figure 7:
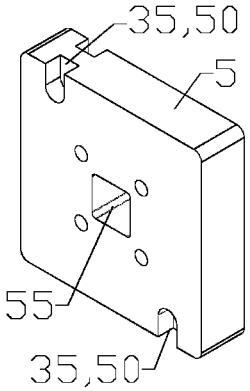
FIG. 7 is a schematic isometric back view of the adapter of FIG. 6.

As shown in FIG. 1, an exemplary embodiment of an adapter includes a base 5 that seats within a recessed adapter seat 10 of an antenna 15 with a feed bore 20. Alternatively, the adapter seat 10 may be provided generally flush and/or protruding from the surface of the antenna 15. The base 5 may be retained seated upon and/or within the adapter seat 10, for example, by retaining elements 25 of the adapter seat 10 such as clips 30 dimensioned to engage interlock cavities 35 of the base 5. The retaining elements 25 may be provided integral with the, for example, machined, die cast or injection molded back side of an input layer of a flat panel-type antenna 15, extending from the adapter seat floor 40 and/or adapter seat sidewall 45. Corresponding interlock cavities 35 provided, for example, as retaining shoulders 50 provided in a periphery of the base 5 proximate, for example, cross corners of the base 5 receive and retain the base 5 in place.

The retention between the base 5 and the adapter seat 10 may be permanent or releasable via access provided for prying and/or biasing the retaining elements 25 free of engagement with the corresponding interlock cavities 35. Alternatively, the retaining elements 25 may be provided as features of the base 5 and the interlock cavities 35 provided on the adapter seat 10 and/or conventional fasteners, such as screws or bolts may be applied. Environmental seals (not shown) may be applied, for example, surrounding the feed bore 20 between the adapter seat 10 and the base 5 and/or around a periphery of the base 5.

The base 5 has a feed aperture 55 aligned coaxial with the feed bore 20 when the base 5 is seated within the adapter seat 10. The feed aperture 55 may have the same cross-section as the feed bore 20, provided for example as a generally rectangular, round or square cross-section, for example as shown in FIGS. 2-7.

Figure 8:
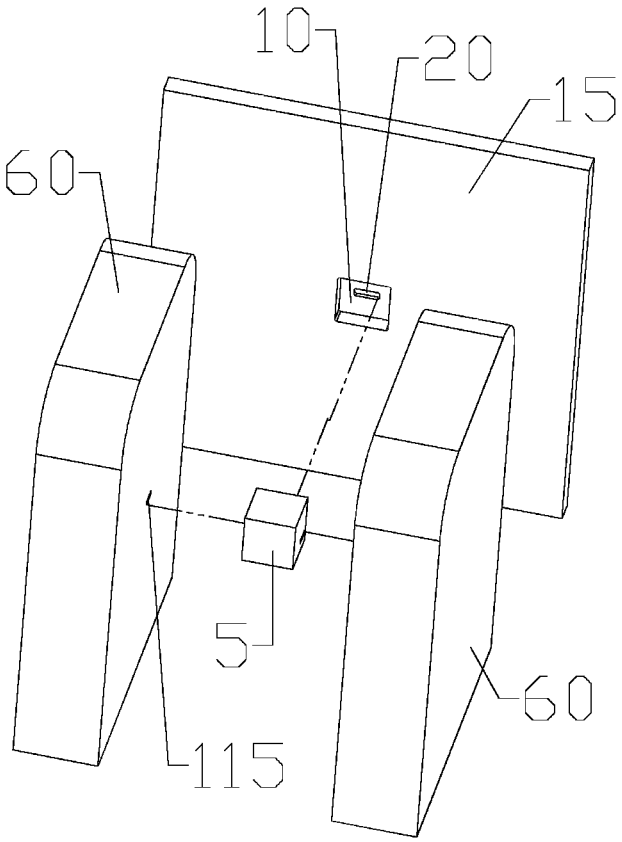
FIG. 8 is a schematic exploded isometric view of an adapter, demonstrating interconnections with the adapter seat of a flat panel antenna and two transceivers.
Figure 9:
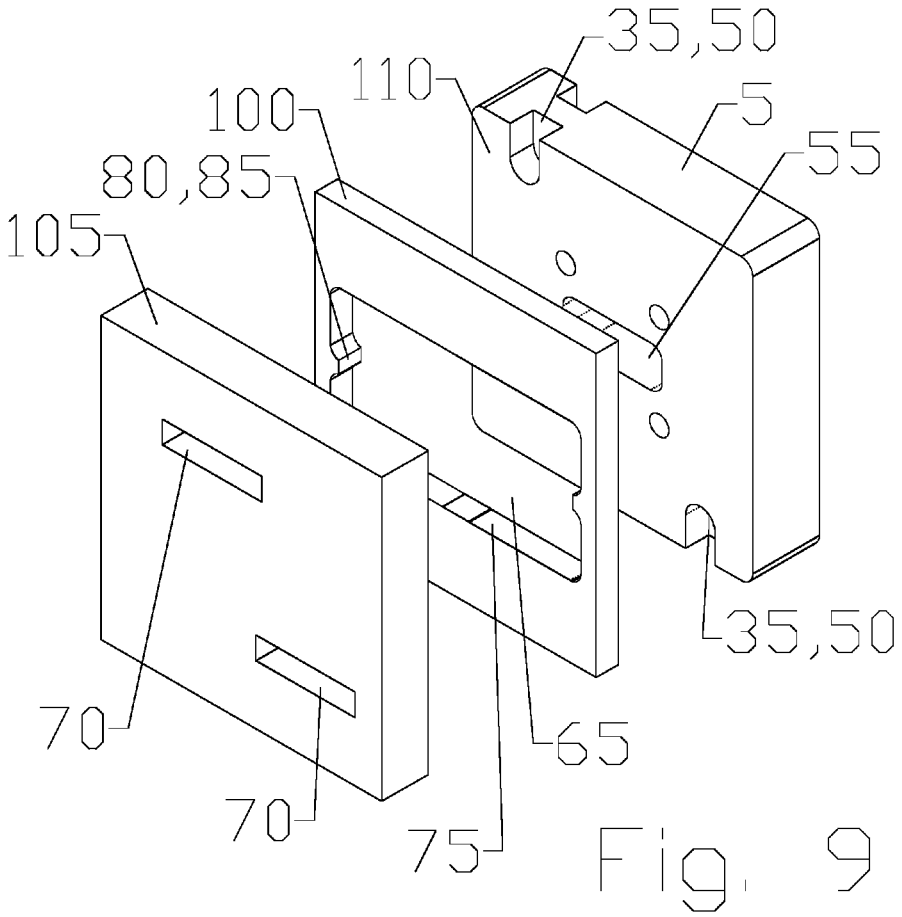
FIG. 9 is a schematic isometric exploded front view of an adapter with a coupling cavity.
Figure 10:
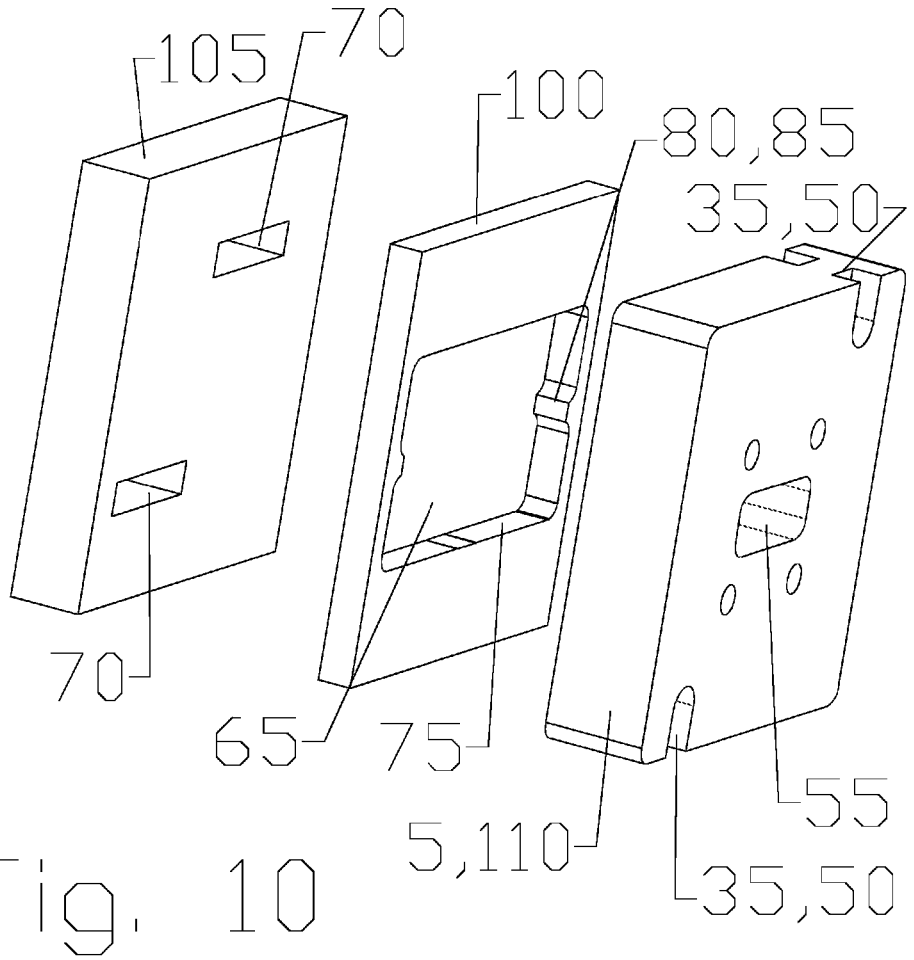
FIG. 10 is a schematic isometric exploded back view of the adapter of FIG. 9.

As demonstrated in FIG. 8, the base 5 may be provided with a coupler functionality, for example to divide the RF signals between dual signal paths to two transceivers 60 instead of just one. As shown in FIGS. 9 and 10, a generally rectangular coupling cavity 65 may be formed in the base 5, linking the feed aperture 55 to two or more output ports 70. The feed aperture 55 and the output ports 70 are provided on opposite sides of the coupling cavity 65. The coupling cavity 65 may be dimensioned, for example, with respect to the wavelength of the expected mid-band operating frequency. That is, the coupling cavity 65 may be provided with dimensions including, for example, a length of 1.5 to 1.7 wavelengths, a width of 0.75 to 1 wavelengths and a depth between the feed aperture 55 and the output ports 70 of approximately 0.2 wavelengths.

Figure 11:
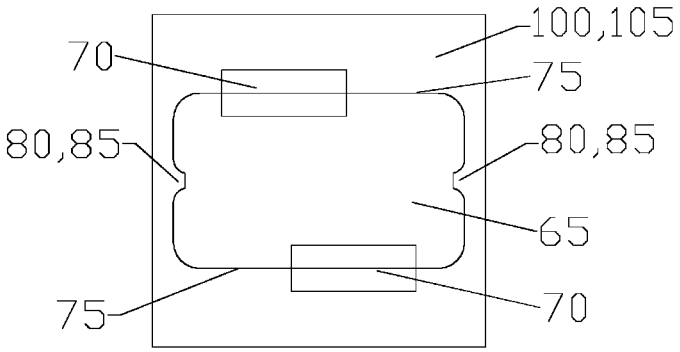
FIG. 11 is a schematic top view of a layer plate with a top layer overlay, demonstrating symmetrical output port alignment with the coupling cavity.
Figure 12:
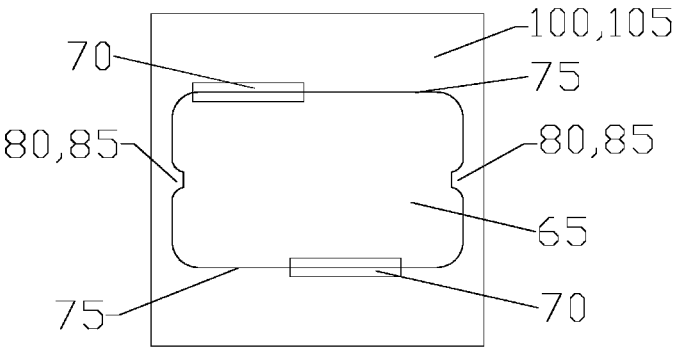
FIG. 12 is a schematic top view of a layer plate with a top layer overlay, demonstrating asymmetrical output port alignment with the coupling cavity.

The output ports 70 may be provided with a generally rectangular cross-section, aligned along a length dimension of the coupling cavity 65 generally parallel to the length of the coupling cavity 65. As shown in FIGS. 11 and 12, the output ports 70 may be further aligned offset with respect to the coupling cavity 65, that is with a midpoint of a width of the output port 70 positioned along a length sidewall 75 of the coupling cavity 65, wherein generally one-half of the output port width is open to the coupling cavity 65.

Further tuning of the electrical performance of the coupler cavity 65 may be applied, for example, by including tuning features 80 such as an inward projecting septum 85 provided upon, for example, each of the width sidewalls 90 of the coupling cavity, as best demonstrated in FIGS. 9 and 10. The tuning features 80 may be provided symmetrically with one another on opposing surfaces and/or spaced equidistant between the output ports 70. Alternatively, the tuning features 80 may be applied in an asymmetrical configuration.

The level of coupling between the feed aperture 55 and each of the output ports 70 may be selected by, for example, applying the output ports 70 aligned symmetrically with a midpoint of the length sidewall 75 of the coupling cavity 65, as demonstrated in FIG. 11. Thereby, the coupling between the feed aperture 55 and each of the output ports 70 may configured to be approximately 3 dB.

Alternatively, where the output ports 70 are positioned aligned asymmetrically with a midpoint of the length sidewall 75, as demonstrated, for example, in FIG. 12, the coupling between the feed aperture 55 and each of the output ports 70 may be reduced, for example, to approximately 6 or 10 dB, depending upon the level of asymmetrical dis-placement applied.

Figure 13:
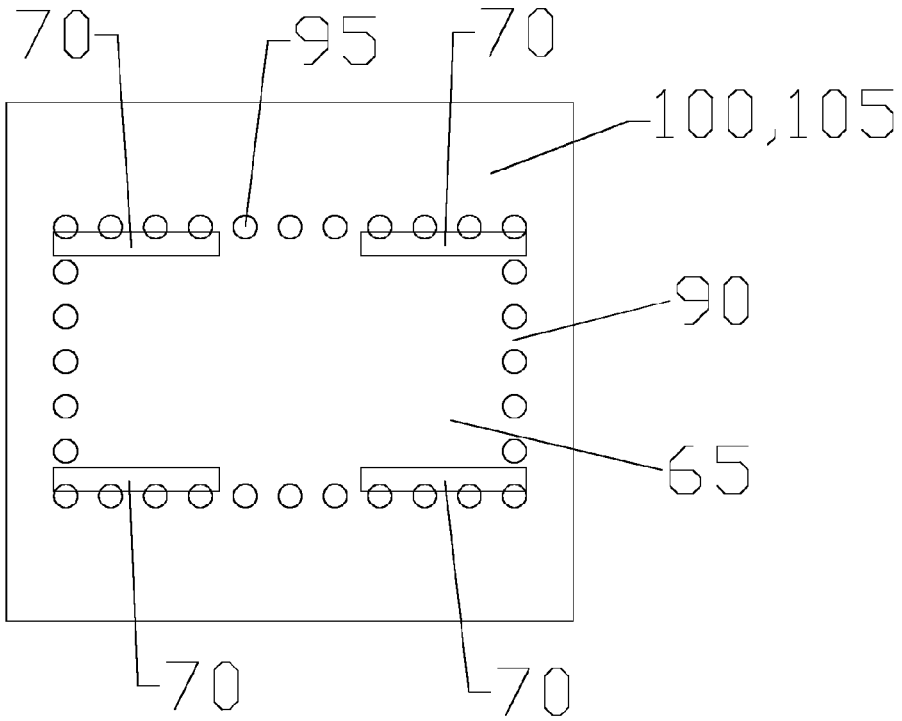
FIG. 13 is a schematic top view of a layer plate with a top layer overlay, demonstrating symmetrical output port alignment with the coupling cavity, with a slotted sidewall layer utilizing pins.
Figure 14:
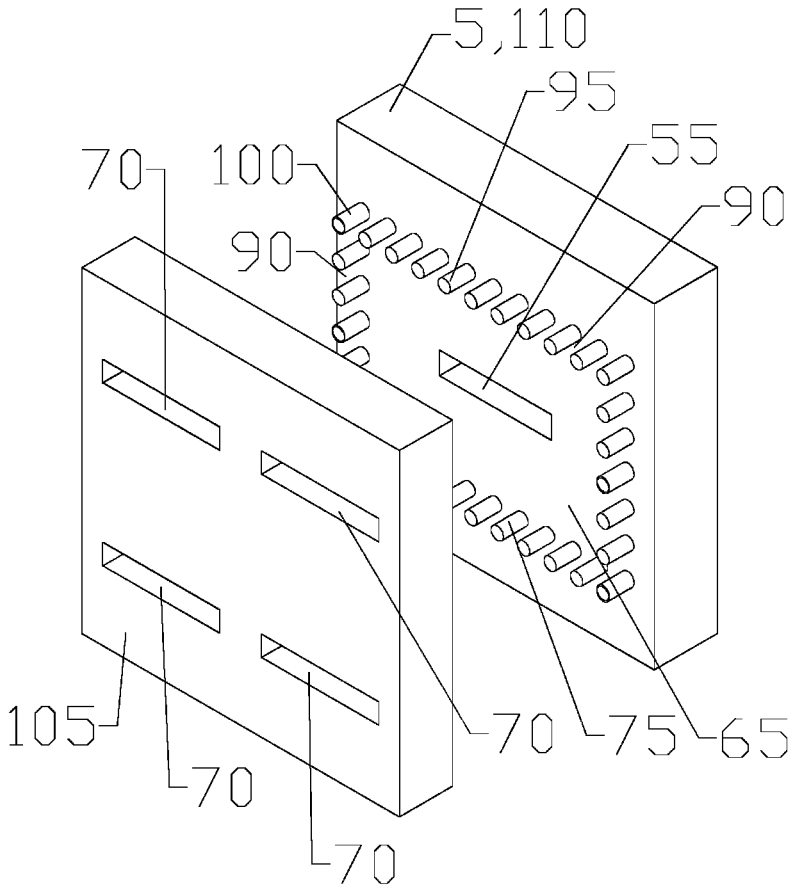
FIG. 14 is a schematic isometric exploded front view of an adapter with a slotted sidewall layer utilizing pins.
Figure 15:
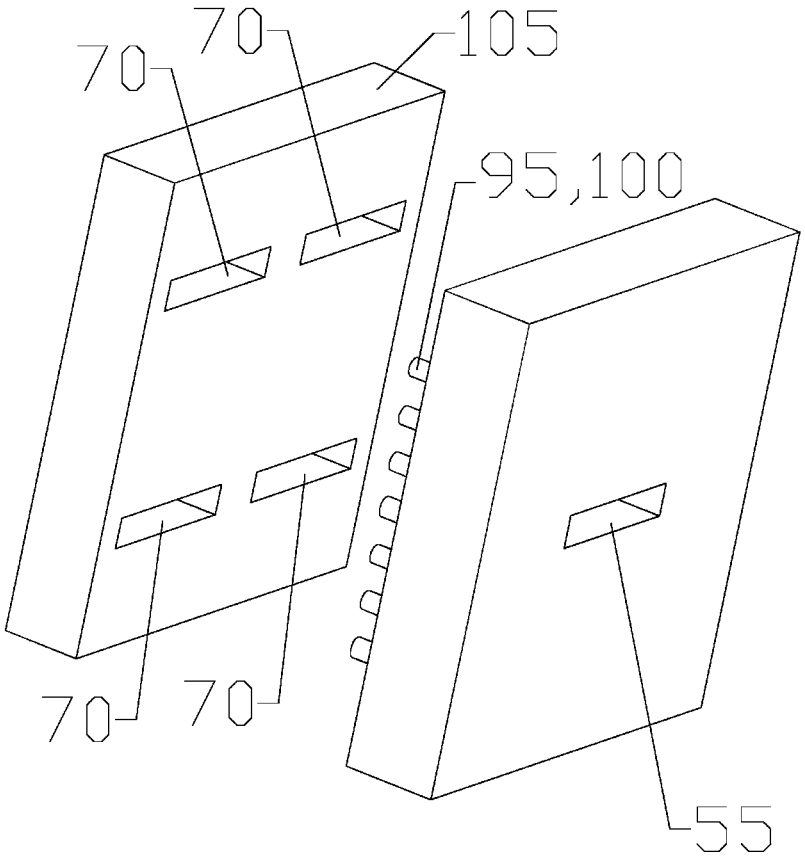
FIG. 15 is a schematic isometric exploded back view of the adapter of FIG. 14.

In further embodiments, for example as shown in FIGS. 13-15, the coupling cavity 65 may be configured with an enhanced thermal dissipation and/or thermal isolation characteristic by providing slots 90 open to an exterior of the adapter in the width and/or length sidewalls 75. The slots 90 may be, for example, orthogonal, forming sidewall elements with rectangular slots 90 between each. The slots 90 may be provided with a side-to-side width of, for example, 0.15 to 0.25 wavelengths of a mid-band operating frequency of the adapter. Alternatively, the sidewall elements may be provided as cylindrical pins 95. The pins 95 may be provided, for example, with a radius of 0.5 wavelengths or less of the mid-band operating frequency of the adapter. To prevent environmental fouling of the signal path, where slots 90 open to the exterior are applied, a further exterior seal may be applied, such as a polymeric cover or the like.

In alternative embodiments, the coupler configurations described herein above may also be applied in adapter embodiments separate from a recessed adapter seat mating configuration. The base 5 has been demonstrated as an element with minimal thickness to highlight the space savings possible. Alternatively, the adapter may include an extended feed aperture waveguide, for example extending the position of the coupler cavity 65 away from the adapter seat 10, closer to input ports 115 of attached transceivers 60 for example as shown schematically in FIG. 8. Similarly, a base 5 with a feed aperture 55 configured with a square or circular cross-section (FIGS. 4-7) may extend prior to entering an OMT for division of simultaneous signals of different polarity prior to being routed to attached transceivers 60.

One skilled in the art will appreciate that the simplified geometry of the coupling cavities 65 may enable a significant simplification of the required layer surface features which may reduce overall manufacturing complexity. For example, the base 5 may be formed cost-effectively with high precision in high volumes via injection molding and/or die-casting technology. One or more separate layers may be applied to arrive at the desired base assembly. For example, as shown in FIGS. 9 and 10, a base layer 110 may be formed separately from a sidewall layer 100 and a top layer 105, which are then stacked upon each other to form the coupling cavity 65 within the final base assembly. Alternatively, the coupling cavity 65 may be formed with a recessed portion as the cavity that is then closed by a top layer 105 or the coupling cavity 65 may be formed as a recessed portion of the top layer 105 that is closed by the base layer 110.

Where injection molding with a polymer material is used to form the layers, a conductive surface may be applied.

Although the coupling cavities and waveguides are described as generally rectangular, for ease of machining and/or mold separation, corners may be radiused and/or rounded and cavity tapers applied in a trade-off between electrical performance and manufacturing efficiency.

As frequency increases, wavelengths decrease. Therefore, as the desired operating frequency increases, the physical features within the adapter, such as bores, steps, and/or slots become smaller and harder to fabricate. As use of the coupling cavity 65 can simplify the physical features required, one skilled in the art will appreciate that higher operating frequencies are also enabled by the adapter, for example up to 26 GHz, above which the required dimension resolution/feature precision may begin to make fabrication with acceptable tolerances cost prohibitive.

From the foregoing, it will be apparent that the present invention brings to the art a high performance adapter with reduced overall dimensions that is strong, lightweight and may be repeatedly cost efficiently manufactured with a high level of precision.

Table of Parts

| | |
|---|---|
| 5 | base |
| 10 | adapter seat |
| 15 | antenna |
| 20 | feed bore |
| 25 | retaining element |
| 30 | clip |
| 35 | interlock cavity |
| 40 | adapter seat floor |
| 45 | adapter seat sidewall |
| 50 | retaining shoulder |
| 55 | feed aperture |
| 60 | transceiver |
| 65 | coupling cavity |
| 70 | output port |
| 75 | length sidewall |
| 80 | tuning feature |
| 85 | septum |
| 90 | slot |
| 95 | pin |
| 100 | sidewall layer |

-continued

| Table of Parts |
| --- |
| 105 top layer |
| 110 base layer |
| 115 vinput port |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. An antenna adapter, for an antenna with a recessed adapter seat with a feed bore, the adapter comprising:

a base with a feed aperture, the base dimensioned to seat within the adapter seat, the feed aperture aligned coaxially with the feed bore;

a cross section of the feed aperture is the same as a cross-section of the feed bore;

the base provided with interlock cavities dimensioned to receive retaining elements of the adapter seat as the base is inserted into the adapter seat, retaining the base within the adapter seat.

2. The antenna adapter of claim 1, wherein the retaining elements are clips and the interlock cavities are retaining shoulders provided in a periphery of the base.

3. The antenna adapter of claim 1, further including a generally rectangular coupling cavity linking the feed aperture to two output ports; the feed aperture and the two output ports respectively provided on opposite sides of the coupling cavity.

4. The antenna adapter of claim 3, wherein the coupling cavity is provided with a length of 1.5 to 1.7 wavelengths, a width of 0.75 to 1 wavelengths and a depth between the feed aperture and the two output ports of approximately 0.2 wavelengths;

the wavelengths being a wavelength of a mid-band operating frequency of the adapter.

5. The antenna adapter of claim 3, wherein each of a width sidewall and a length sidewall of the coupling cavity is provided with slots open to an exterior of the adapter.

6. The antenna adapter of claim 5, wherein the width and length sidewalls are formed by a plurality of cylindrical pins.

7. The antenna adapter of claim 6, wherein a radius of each of the plurality of cylindrical pins is 0.05 wavelengths or less, the wavelengths being a wavelength of a mid-band operating frequency of the adapter.

8. The antenna adapter of claim 5, wherein each of the slots are generally 0.15 to 0.25 wavelengths, the wavelengths being a wavelength of a mid-band operating frequency of the adapter.

9. The antenna adapter of claim 3, wherein the two output ports are generally rectangular in shape and are respectively aligned along a length dimension thereof which is generally parallel to the length of the coupling cavity.

10. The antenna adapter of claim 9, wherein the two output ports are positioned to be aligned asymmetrically with a midpoint of the length of the coupling cavity.

11. The antenna adapter of claim 10, wherein the coupling between the feed aperture and each of the two output ports is approximately 10 dB.

12. The antenna adapter of claim 10, wherein the coupling between the feed aperture and each of the two output ports is approximately 6 dB.

13. The antenna adapter of claim 9, wherein the two output ports each have an output port width that is defined along a length sidewall of the coupling cavity, the two output ports are generally aligned with each other with respect to a midpoint of the output port width thereof, whereby generally one-half of each output port width is open to the coupling cavity.

14. The antenna adapter of claim 9, further including an inwardly projecting septum provided upon at least one sidewall of the coupling cavity.

15. The antenna adapter of claim 9, wherein the two output ports are positioned to be aligned symmetrically with a midpoint of the length of the coupling cavity.

16. The antenna adapter of claim 15, wherein the coupling between the feed aperture and each of the two output ports is approximately 3 dB.

* * * * *